US007854529B2

(12) United States Patent
Uke

(10) Patent No.: US 7,854,529 B2
(45) Date of Patent: Dec. 21, 2010

(54) BEZEL-INTEGRATED THERMAL CONDUCTORS

(75) Inventor: Alan K. Uke, Del Mar, CA (US)

(73) Assignee: Underwater Kinetics, Inc., Poway, CA (US)

( * ) Notice: Subject to any disclaimer, the term of this patent is extended or adjusted under 35 U.S.C. 154(b) by 409 days.

(21) Appl. No.: 11/848,003

(22) Filed: Aug. 30, 2007

(65) Prior Publication Data

US 2009/0021929 A1 Jan. 22, 2009

Related U.S. Application Data

(60) Provisional application No. 60/841,475, filed on Aug. 30, 2006.

(51) Int. Cl.
*F21L 4/00* (2006.01)

(52) U.S. Cl. ..... 362/202; 362/205

(58) Field of Classification Search ..... 362/96, 362/202, 205, 208

See application file for complete search history.

(56) References Cited

U.S. PATENT DOCUMENTS

| | | | | |
|---|---|---|---|---|
| 4,325,107 | A | 4/1982 | MacLeod | |
| 6,702,452 | B2 | 3/2004 | Jigamian et al. | |
| 7,083,297 | B2 | 8/2006 | Matthes et al. | |
| 7,281,815 | B1 * | 10/2007 | Gustafson et al. | 362/206 |
| 2003/0137834 | A1 * | 7/2003 | Jigamian et al. | 362/205 |

* cited by examiner

*Primary Examiner*—David V Bruce
(74) *Attorney, Agent, or Firm*—Daniel M. Chambers; BioTechnology Law Group

(57) ABSTRACT

Flashlight bezels, which comprise a bezel, lens, and a thermal conductor disposed in and through the lens so as to be positioned conduct heat from a light source positioned to one side of the lens to space on the opposite side of the lens, are described. When included in a flashlight, the thermal conductor portion of the bezel becomes associated with the light source so that heat generated by the light source, when energized, can be efficiently transferred to the environment, for example, water, in which the flashlight is being used. By so doing, the efficiency of the light source can be maintained, the service life of the light source may be extended, etc.

24 Claims, 3 Drawing Sheets

SECTION A-A
SCALE 1 : 1

SECTION A-A
SCALE 1 : 1

BEZEL-INTEGRATED THERMAL CONDUCTORS

RELATED APPLICATION

This application claims the benefit of, and priority to, U.S. provisional patent application Ser. No. 60/841,475, filed Aug. 30, 2006, which provisional patent application is hereby incorporated by reference in its entirety for all purposes.

TECHNICAL FIELD OF THE INVENTION

The present invention relates to bezel-integrated thermal conductors, or heat sinks, and devices such as flashlights that include such components. Such flashlights are particularly well-suited for use in water, such as by divers.

BACKGROUND OF THE INVENTION

1. Introduction

The following description includes information that may be useful in understanding the present invention. It is not an admission that any such information is prior art, or relevant, to the presently claimed inventions, or that any publication specifically or implicitly referenced is prior art.

2. Background

Flashlights are popular devices, and have many applications. Traditionally, flashlights have employed an incandescent light bulb as the light source. Recently, flashlights have been introduced that employ one or more light emitting diodes (LEDs) as the light source. LEDs offer many advantages over traditional incandescent bulbs, including greater efficiency, durability, and longer useful lives. As with traditional flashlights, however, the use of LED-based flashlights is also typically constrained by battery life. Also, the efficiency and service life of LEDs can be radically affected by operating temperature. Accordingly, improvements in temperature control would be advantageous.

In the context of underwater diving, the usual reduced visibility encountered underwater requires a source of light if a diver is to, for example, perform useful work, and much effort has been devoted to develop underwater flashlights suitable for use by divers. Those working to develop flashlights capable of operating in an underwater environment of high water pressure, low temperature, corrosive seawater, etc., have encountered many engineering challenges. For example, to be effective in providing the necessary illumination under extreme underwater conditions for extended periods of time, an underwater flashlight must be lightweight and easy to handle and carry, be rugged and versatile in producing an appropriate beam pattern, have exceptional watertight integrity, and be easy to repair and service. It should also be reliable, particularly with regard to providing light for the duration of, for example, a dive.

Unfortunately, efforts to date have provided flashlights that are not optimal. Drawbacks include: bulkiness, which renders such flashlights unwieldy and difficult to manipulate and hold for extended periods of time; as well as being unable to produce a sufficient, quality light beam for an extended period of time. Clearly, there still exists a need for novel and improved configurations for flashlights suitable for use underwater, particularly by divers.

3. Definitions

Before describing the instant invention in detail, several terms used in the context of the present invention will be defined. In addition to these terms, others are defined elsewhere in the specification, as necessary. Unless otherwise expressly defined herein, terms of art used in this specification will have their art-recognized meanings.

A "patentable" composition, process, machine, or article of manufacture according to the invention means that the subject matter satisfies all statutory requirements for patentability at the time the analysis is performed. For example, with regard to novelty, non-obviousness, or the like, if later investigation reveals that one or more claims encompass one or more embodiments that would negate novelty, non-obviousness, etc., the claim(s), being limited by definition to "patentable" embodiments, specifically exclude the unpatentable embodiment(s). Also, the claims appended hereto are to be interpreted both to provide the broadest reasonable scope, as well as to preserve their validity. Furthermore, if one or more of the statutory requirements for patentability are amended or if the standards change for assessing whether a particular statutory requirement for patentability is satisfied from the time this application is filed or issues as a patent to a time the validity of one or more of the appended claims is questioned, the claims are to be interpreted in a way that (1) preserves their validity and (2) provides the broadest reasonable interpretation under the circumstances.

A "plurality" means more than one.

SUMMARY OF THE INVENTION

The object of this invention is the provision of patentable articles that comprise a thermal conductor integrated with a bezel, particularly a flashlight bezel that includes a housing and a lens.

Thus, in one aspect, the invention concerns patentable flashlight bezel assemblies having an integrated thermal conductor, also referred to herein as a heat sink. Such bezel assemblies comprise (i) a bezel that houses a lens having an outer surface disposed opposite an inner surface and a bore that extends from the outer surface to the inner surface; and (ii) a thermal conductor disposed in the bore. In preferred embodiments, the bezel is adapted for detachment from a flashlight body; the bore in the lens is cylindrical; and the thermal conductor comprises a heat input portion spaced from a heat dissipation portion by a lens spanning portion. Particularly preferred are assemblies wherein the bezel is made of a material selected from the group consisting of plastic, metal, and a composite material; the lens is made of a material selected from the group consisting of plastic, glass, and quartz; the heat dissipation portion of the thermal conductor comprises one or more fins; and the thermal conductor comprises metal selected from the group consisting of silver, copper, gold, aluminum, iron, platinum, and an alloy of any of the foregoing. Optionally, the bezel assembly further comprises a thermal insulator disposed in the bore and positioned between the lens and the thermal conductor. Optionally, the bezel assembly further comprises a reflector; and the reflector further comprises a light source disposed in the reflector such that the light source is spaced from the lens and is in contact with the thermal conductor. Particularly preferred are assemblies wherein the light source comprises an electric lamp selected from the group consisting of an LED and a light bulb.

A related aspect of the invention relates to flashlights. Typically, such flashlights include a flashlight bezel assembly according to the invention attached to a flashlight body, preferably in an easily detachable manner. In such embodiments, the flashlight bezel assembly preferably further includes a reflector having a light source disposed therein such that the light source is spaced from the lens and is in thermal communication with the thermal conductor. The flashlight body comprises a chamber for a power supply, and circuitry that places the power supply, when present, in electrical communication with the light source. Any such flashlight, regardless of the particular embodiment, also includes such other components, circuitry, and associated electronics and control logic, if any, as may be required for the device to operate as intended when a suitable power supply is included. Preferred power supplies include one or more rechargeable or non-rechargeable batteries, although the invention contemplates the inclusion or use any suitable portable or fixed DC, AC, or switchable AC/DC power supply to energize the particular light source(s) in the device. Because such flashlights have a heat-dissipating device, i.e., the thermal conductor for conducting heat from the light source to the surrounding environment, to prevent undesired heat accumulation, the service life and light output efficiency of the lamp(s) in the light source can be improved as compared to conventional flashlights.

Another aspect relates to methods of illuminating articles or spaces using a flashlight according to the invention. Still other aspects of the invention relate to methods for increasing light source efficiency and/or service life.

These and other aspects and embodiments of the invention are discussed in greater detail in the sections that follow.

BRIEF DESCRIPTION OF THE FIGURES

This patent application may contain at least one figure executed in color. In such event, copies of this patent application with color drawing(s) will be provided upon request and payment of the necessary fee.

As those in the art will appreciate, the following description describes certain preferred embodiments of the invention in detail, and is thus only representative and does not depict the actual scope of the invention. Before describing the present invention in detail, it is understood that the invention is not limited to the particular assemblies, devices, systems, and methods described, as these may vary. Any suitable circuitry, components, and material now known or later developed can be used to produce the devices of the invention. It is also to be understood that the terminology used herein is for the purpose of describing particular embodiments only, and is not intended to limit the scope of the invention defined by the appended claims.

DETAILED DESCRIPTION OF THE INVENTION

As those in the art will appreciate, the following detailed description describes certain preferred embodiments of the invention in detail, and is thus only representative and does not depict the actual scope of the invention. Before describing the present invention in detail, it is understood that the invention is not limited to the particular aspects and embodiments described, as these may vary. It is also to be understood that the terminology used herein is for the purpose of describing particular embodiments only, and is not intended to limit the scope of the invention defined by the appended claims The invention will be further described by reference to the drawings, which are described in detail below. This description shall in no way to be considered to limit the scope of the invention in any manner.

Figure 1:
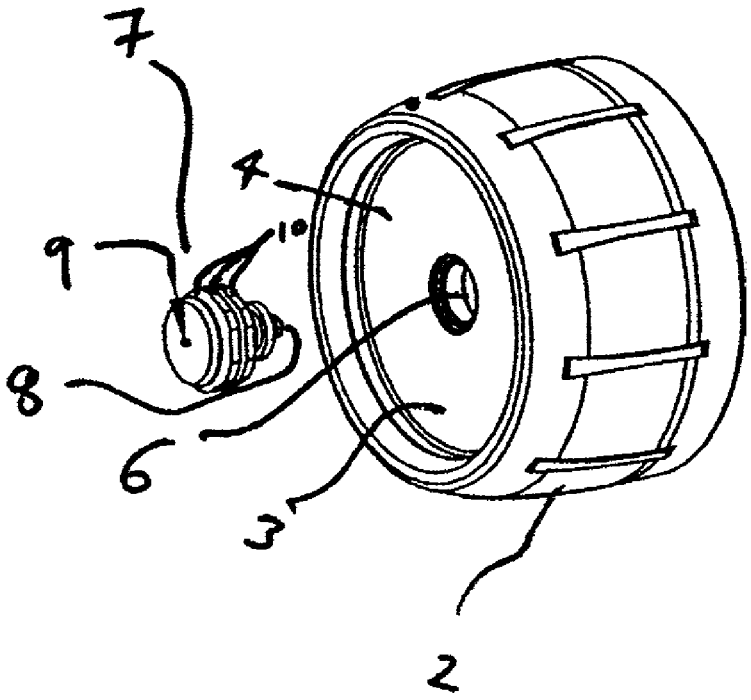
FIG. 1 is an exploded view of a bezel assembly of the present invention.

The present invention provides a flashlight bezel assembly having an integrated thermal conductor. With reference to FIG. 1, such assemblies comprise a bezel that houses a lens having an outer surface disposed opposite an inner surface and a bore that extends from the outer surface to the inner surface; and a thermal conductor disposed in the bore. This flashlight bezel can be connected to a flashlight body to provide flashlight having a heat-dissipating device which prevents breakdown from heat accumulation, thereby decreasing the breakdown rate of the flashlight and increasing the use life thereof.

Referring now in more detail to FIG. 1, a bezel assembly 1 comprises a bezel 2 housing a lens 3. The lens comprises an outer surface 4 disposed opposite an inner surface 5 (not visible), a cylindrical bore 6 that extends from the outer surface 4 to the inner surface 5, and a thermal conductor 7 disposed in the bore 6. In FIG. 1, the thermal conductor 7 comprises a heat input portion 8 and a heat dissipation portion 9 wherein the heat dissipation portion 9 comprises three fins 10.

Figure 2:
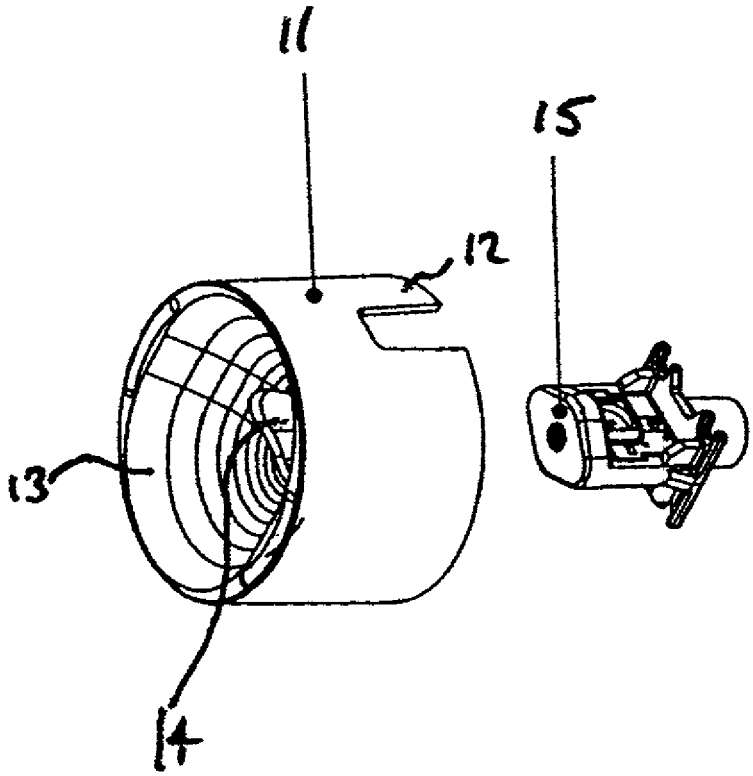
FIG. 2 is also an exploded view of a bezel assembly of the present invention.

In FIG. 2, the bezel assembly depicted in FIG. 1 is shown to further comprise a reflector 11, wherein the reflector comprises an internal end 12 and an external opening 13. The reflector 11 has a central bore 14 at the internal end 12 through which a light source 15 may be disposed such that, following assembly, the light source 15 is spaced from the lens 3 and is in thermal connection with the thermal conductor 7. The bezel 2 has female threads 16 (see FIG. 3) for attachment to a flashlight body. Optionally, the bezel assembly 1 further comprises a thermal insulator (not shown) disposed in the bore 6 and positioned between the lens 3 and the thermal conductor 7.

The bezel 2 is preferably made of a material selected from the group consisting of plastic, metal, and a composite material. The lens 3 is preferably made of a material selected from the group consisting of plastic, glass, and quartz. The reflector 11 is preferably metal such as Aluminum so that it also helps dissipate heat from the light source 15. The thermal conductor 7 is preferably metal selected from the group consisting of silver, copper, gold, aluminum, iron, platinum, and an alloy of any of the foregoing. The light source 15 is preferably an electric lamp selected from the group of an LED and a light bulb.

Figure 3:
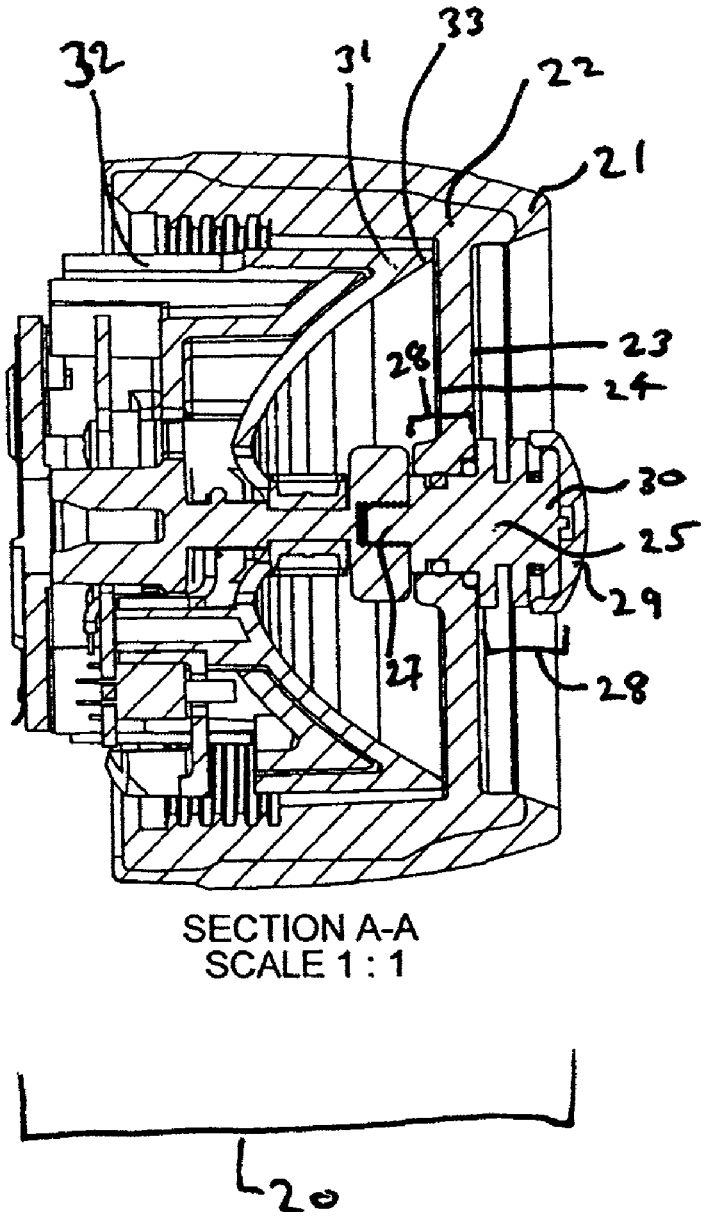
FIG. 3 is a cross-sectional view of the bezel assembly of the present invention detached from a flashlight body.

FIG. 3 shows a cross section of a preferred flashlight bezel assembly (20) according to the invention. The bezel (21) housing that houses a lens (22) mated to the bezel (21). The lens has an outer surface (23) disposed opposite an inner surface (24), and the lens also has a centered cylindrical bore into which the thermal conductor (25) is inserted such that its lens spanning portion (26) spaces the heat input portion (27) from the finned heat dissipation portion (28), to which a guard (29) is attached to the distal end (30) of the heat dissipation portion (28). A reflector (31) having an internal end (32) and an external opening (33) is positioned inside the threaded bezel such that the reflector's central bore has a light source disposed therein such that the light source is spaced from the lens and is in thermal connection with the heat input portion (27) of the thermal conductor (25). The bezel has female threads for mating to the male threads on a threaded flashlight body (not shown).

More generally, a large number of different flashlight designs are known and may be readily adapted for use in the context of the invention. Typically, most flashlights have a body containing a power source and a bezel assembly containing a light source. The body is generally a hollow housing shaped to contain one or more batteries used to power the light source. The batteries may be of any shape, size, and power output, and, when two or more batteries are employed, they may be arrayed in a single row, or in a side-by-side configuration. The bezel assembly generally includes a fitting or socket for a light source and/or has a light source, and may also include a reflector(s) to help direct light from the lamp. For many years, most portable handheld flashlights used an incandescent bulb to provide light and batteries as the power source.

As relates specifically to underwater flashlights, potential overheating is even more pronounced and problematic, due mainly to the low undersea temperatures and the fact that the entire lighting system is typically made of plastic and sealed to prevent infiltration of water. As such, in order to provide the diver with a reliable and optimal LED-based underwater flashlight, it is important that the flashlight not only effectively dissipate heat generated by the LED(s), but also be watertight.

The flashlight reflector and light source depicted in FIG. 2 can be assembled into a suitable bezel adapted to receive these items. The bezel preferably will contain a lens or lens system. The bezel may be assembled with a complementary flashlight body. The bezel may be attached or otherwise associated with the flashlight body using any suitable mating configuration, for example, a threaded male portion on a flashlight body adapted to receive a complementary female threaded portion of the flashlight. The flashlight body and bezel can be made of any suitable material, including metals and plastics. Particularly preferred are thermoplastics molded into the desired shapes. Preferably, the flashlight body will also contain a chamber for housing the power supplied, which in many embodiments will comprise one or more removable batteries.

All patents, patent applications, and publications mentioned in the specification are indicative of the levels of those of ordinary skill in the art to which the invention pertains. Each patent, patent application, and publication cited herein is hereby incorporated by reference in its entirety for all purposes regardless of whether it is specifically indicated to be incorporated by reference in the particular citation.

All of the articles, compositions, and methods described and claimed herein can be made and executed without undue experimentation in light of the present disclosure. Moreover, it is intended to obtain rights which include alternative and/or equivalent embodiments to the extent permitted, including alternate, interchangeable, and/or equivalent structures, functions, ranges, or steps to those claimed, whether or not such alternate, interchangeable and/or equivalent structures, functions, ranges, or steps are disclosed herein, and without intending to publicly dedicate any patentable subject matter, as it is intended that all patentable subject matter disclosed herein eventually be the subject of patent claims.

The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Also, the invention illustratively described herein suitably may be practiced in the absence of any element(s) not specifically disclosed herein. Thus, for example, in each instance herein any of the terms "comprising", "consisting essentially of", and "consisting of" may be replaced with either of the other two terms. Furthermore, while the compositions and methods of this invention have been described in terms of preferred embodiments, it will be apparent to those of skill in the art that variations may be applied to the compositions and methods and in the steps or in the sequence of steps of the method described herein without departing from the spirit and scope of the invention. Thus, it should be understood that although the present invention has been specifically disclosed by preferred embodiments and optional features, modification and variation of the concepts herein described may be resorted to by those skilled in the art, and that such modifications and variations are considered to be within the scope of this invention as defined by the appended claims.

What is claimed is:

1. A flashlight bezel assembly, comprising:

a bezel that houses a lens, wherein the lens comprises an outer surface opposite an inner surface and a bore through the lens that extends from the outer surface of the lens to the inner surface of the lens; and a thermal conductor disposed in the bore.

2. A flashlight bezel assembly according to claim 1 wherein the bezel is adapted for attachment to a flashlight body.

3. A flashlight bezel assembly according to claim 1 wherein the bezel is made of a material selected from the group consisting of plastic, metal, and a composite material.

4. A flashlight bezel assembly according to claim 1 wherein the lens is made of a material selected from the group consisting of plastic, glass, and quartz.

5. A flashlight bezel assembly according to claim 1 wherein the bore in the lens is cylindrical.

6. A flashlight bezel assembly according to claim 1 further comprising a thermal insulator disposed in the bore and positioned between the lens and the thermal conductor.

7. A flashlight bezel assembly according to claim 1 wherein the thermal conductor comprises a heat input portion spaced from a heat dissipation portion by a lens spanning portion.

8. A flashlight bezel assembly according to claim 7 wherein the heat dissipation portion of the thermal conductor comprises one or more fins.

9. A flashlight bezel assembly according to claim 7 wherein the thermal conductor comprises metal.

10. A flashlight bezel assembly according to claim 9 wherein the metal is selected from the group consisting of silver, copper, gold, aluminum, iron, platinum, and an alloy of any of the foregoing.

11. A flashlight bezel assembly according to claim 1 further comprising a reflector.

12. A flashlight bezel assembly according to claim 11 further comprising a light source disposed in the reflector such that the light source is spaced from the lens and is thermally connected with the thermal conductor.

13. A flashlight bezel assembly according to claim 12 wherein the light source comprises an electric lamp.

14. A flashlight bezel assembly according to claim 13 wherein the electric lamp is selected from the group consisting of an LED and a light bulb.

15. A flashlight, comprising:

a. a flashlight bezel assembly according to claim 14 and b. a flashlight body connected to the flashlight bezel assembly, wherein the flashlight body comprises:

i. a chamber for a power supply; and ii. circuitry that places the power supply, when present, in electrical communication with the light source.

16. A flashlight according to claim 15, wherein the power supply comprises a battery.

17. A flashlight according to claim 15 further comprising a power supply.

18. A method of illumination, comprising using a flashlight according to claim 17 to illuminate an area.

19. A method of increasing light source efficiency, comprising using a flashlight according to claim 17 to transfer heat generated by the light source, when energized, from the light source to a medium in which the flashlight is being used, thereby increasing efficiency of the light source.

20. A method according to claim 19, wherein the medium is a fluid medium, optionally water.

21. A method according to claim 19, wherein the light source comprises an electric lamp, optionally an LED.

22. A method of increasing light source service life, comprising using a flashlight according to claim 17 to transfer heat generated by the light source, when energized, from the light source to a medium in which the flashlight is being used.

23. A flashlight according to claim 22, wherein the medium is a fluid medium, optionally water.

24. A method according to claim 23, wherein the light source comprises an electric lamp, optionally an LED.

* * * * *